United States Patent [19]

Mathews

[11] 4,020,561

[45] May 3, 1977

[54] METHOD AND APPARATUS FOR DRYING GRAIN

[76] Inventor: Bernard C. Mathews, 7919 Rte. 14, Crystal Lake, Ill. 60014

[22] Filed: Dec. 17, 1975

[21] Appl. No.: 641,558

[52] U.S. Cl. ..... 34/13; 34/31; 34/65; 34/167; 34/174

[51] Int. Cl.[2] ..... F26B 17/12

[58] Field of Search ..... 34/13, 31, 61, 64, 65, 34/167, 174

[56] References Cited

UNITED STATES PATENTS

| | | | |
|---|---|---|---|
| 1,528,696 | 3/1925 | Robinson | 34/65 X |
| 2,764,819 | 10/1956 | Hallman | 34/65 X |
| 3,274,699 | 9/1966 | Naylor | 34/65 X |
| 3,400,466 | 9/1968 | McClaren | 34/174 X |

*Primary Examiner*—Robert G. Nilson

*Attorney, Agent, or Firm*—Burmeister, York, Palmatier, Hamby & Jones

[57] ABSTRACT

The grain is cleaned prior to heating. Then it moves downwardly as a column between perforated walls and is traversed by several airstreams of differing temperatures which provide three or more heating zones and a cooling zone. The temperature of each heating zone beneath the uppermost is less than that of the heating zone next above it. In the cooling zone, the air is drawn inwardly through the grain and into a duct by an exhaust fan. Any fines dislodged during cooling are filtered from the spent cooling air as it emerges from the exhaust fan. The filter is a fine mesh circular screen. A continuously rotating suction shoe removes the fines from the screen. The initial grain cleaning device has two concentric tumbling screens, one for collecting large particles and the other for screening out the fines. The fines are then conveyed through a heating zone and dried, and then run through a dust collector together with the fines from the filter.

10 Claims, 9 Drawing Figures

60
49
57
57
63
63
96
64
96
40
39
38
22
28
75
77
4
78
79
4
82
81
83
89
31
88
18
29
34
30
87
21
21
25
20
20
91
43
43
90

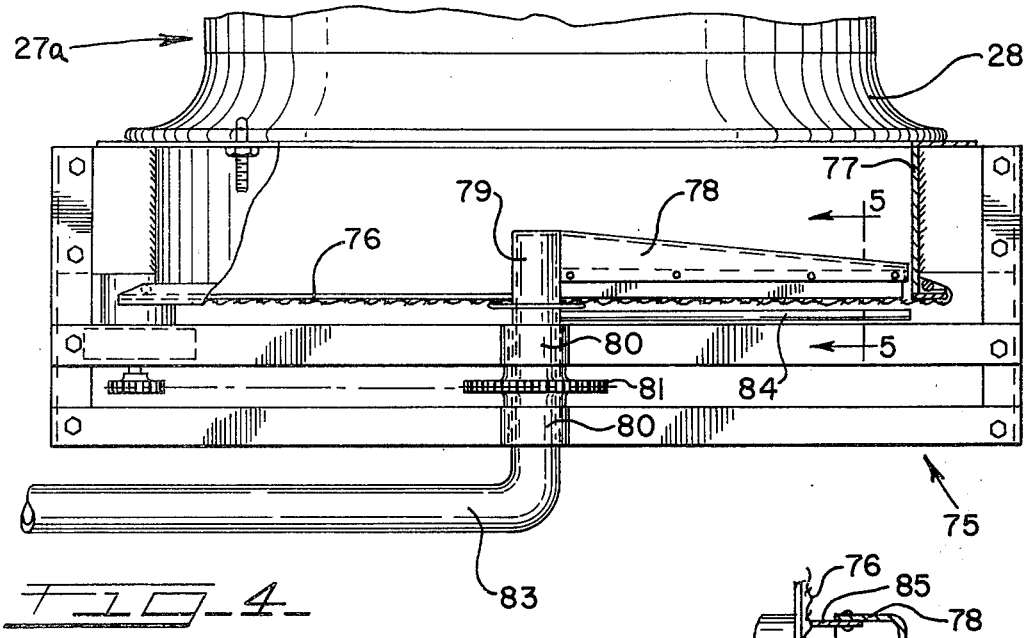
FIG. 4
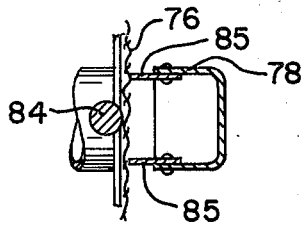
FIG. 5
FIG. 6
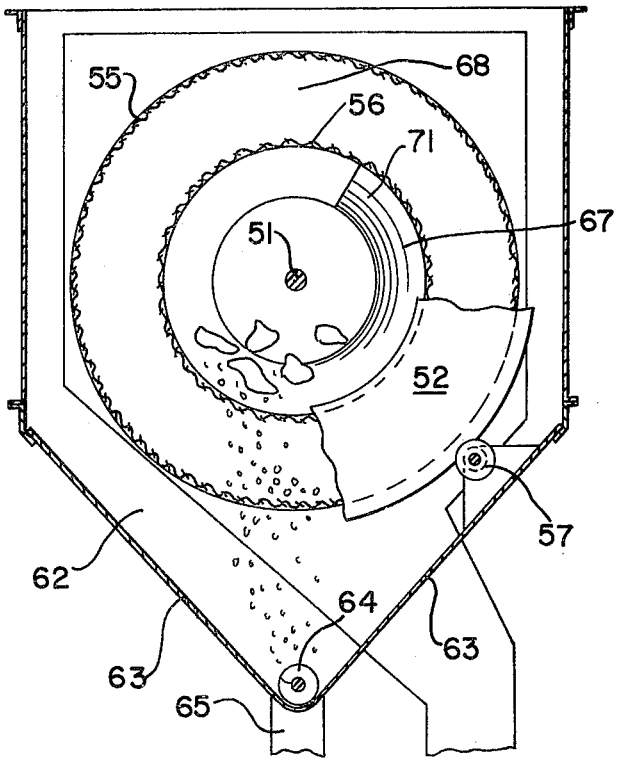
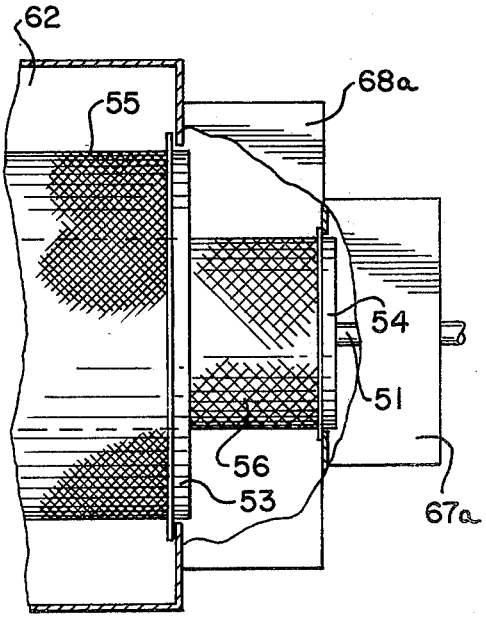
FIG. 7

FIG. 8
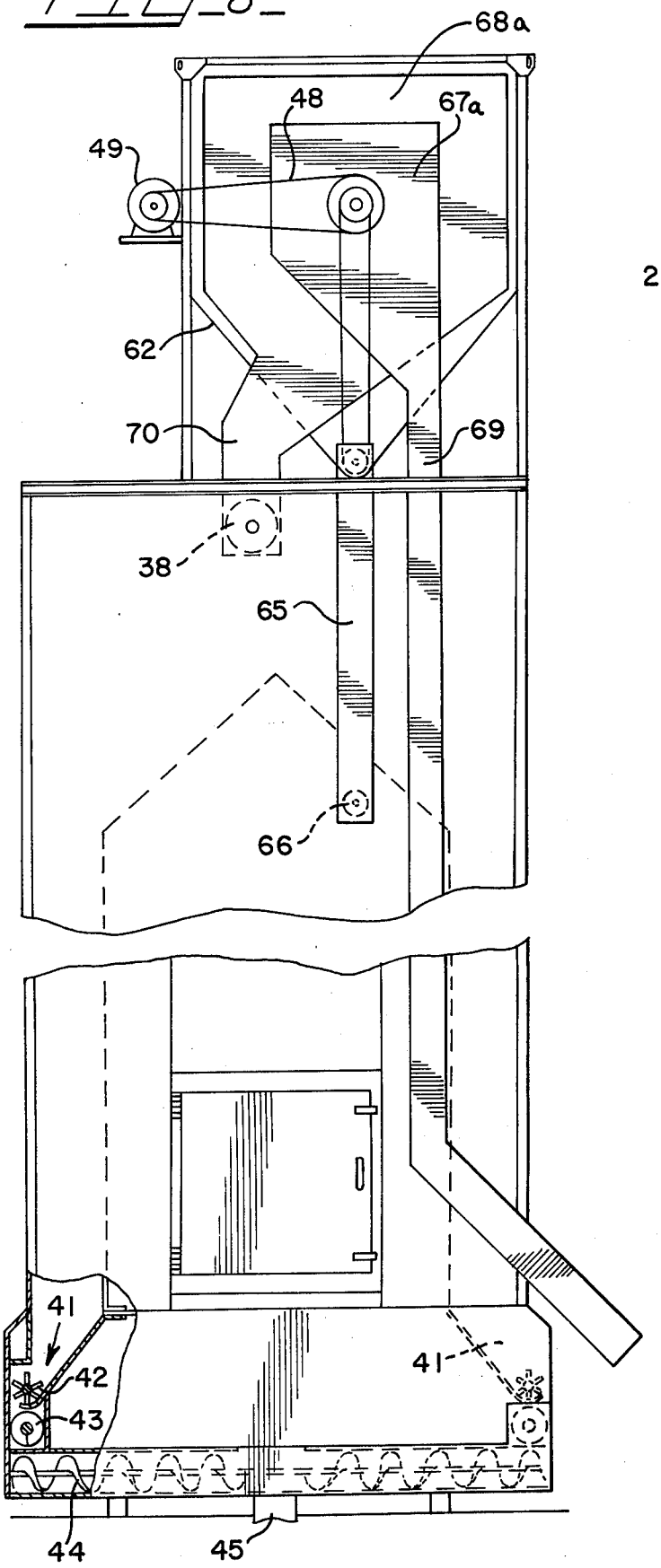
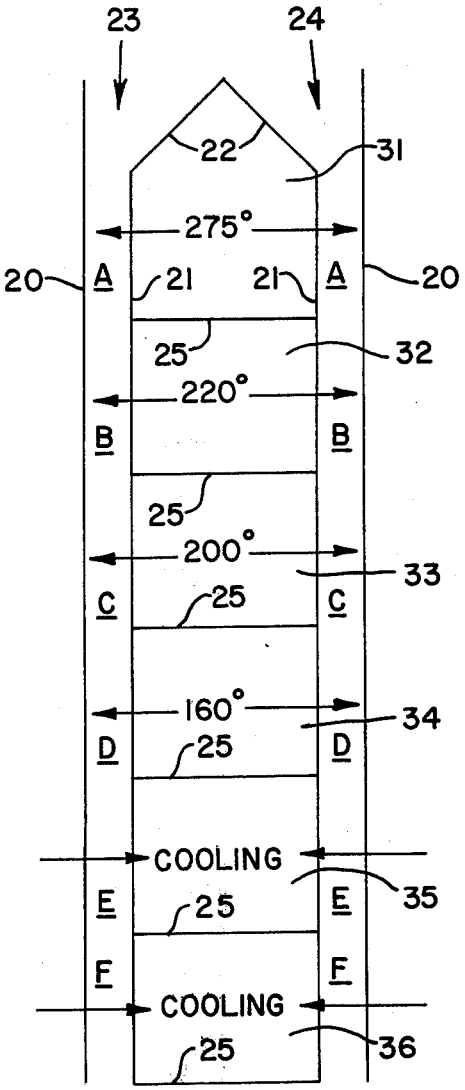
FIG. 9

METHOD AND APPARATUS FOR DRYING GRAIN

This invention relates to a grain dryer of the perforated wall type having cross-flow air. The grain descends between two perforated walls, the body of grain at this point being referred to as a grain column. Two of such column providing means are disposed on either side of a plenum, or duct, from which heated air passes laterally through the grain columns, causing them to dry. Beneath the heating zone is a cooling zone in which ambient temperature air is either blown outwardly through the grain columns, or sucked inwardly, in which case the fan for the cooling duct is an exhaust fan. Grain dryers of the cross-flow type are a source of air pollution because the area of the outer walls of the grain columns is so great, that the outwardly blowing airstream is exceedingly diffuse. It is not practical to filter a diffuse airstream of such large cross section. Therefore, the fines are blown outwardly into the atmosphere.

According to my invention, I remove the fines in two stages: First, I remove a substantial portion of the fines from the moist incoming grain before it has been fed to the grain columns; Secondly, I filter the fines from the cooling air. By drawing the air inwardly through the grain column into the cooling duct by means of an exhaust fan in the cooling duct, the cooling airstream is concentrated to the extent that it can be filtered.

Since a large portion of the fines are removed during the first cleaning stage, there are not as many fines dislodged by the outwardly cross-flow airstream in the heating as there would otherwise be.

I have found that if 50% or more of the fines are removed during the first cleaning stage that there will be relatively few fines dislodged in the heating zone.

What I believe occurs is that whatever fines that can be readily separated by a tumbling screen during the first stage are the ones which would otherwise be dislodged by the hot airstream. The much smaller fines tend to adhere to the grain or kernels at least during the heating stage.

Grain, which term as I use it includes corn or maize kernels and beans, when subjected to a hot airstream, "sweats". That is, as the moisture is removed from the surface, moisture from the interior of the seed or kernel migrates to the surface with the result that the surface is continuously moist up to a certain point in the drying process. The fines and chaff not dislodged during the first cleaning stage will tend to cling to the moist kernel surface up until the time that this certain point or non-sweating grain temperature is reached. If at this time the airflow is reversed, the fines and chaff dislodged will be drawn inwardly and entrapped by the filter screen of the second cleaning stage.

The objective is to remove from 60 to 80% of the chaff and fines in the first cleaning stage. Then I have found that there is very little, if any, air pollution from air blowing out through the columns in the heating zones.

My invention also includes the step of controlling the drying temperature so as to achieve the desired adherence, and without stress cracking the grain. This is accomplished by providing three or more heat zones, each individually temperature controlled, the uppermost zone having the highest temperature and the temperatures decreasing from zone to zone with the lowermost heating zone having a temperature sufficiently low so that the grain will not exceed the stress cracking temperature which, for example, in the case of corn is about 147° F., and below the non-sweating grain temperature. Although stress cracking is believed to be due to exposing grain to sudden changes in air temperature, other considerations such as moisture content must be taken into consideration. I have found, for example, that cold wet corn in this process can be subjected to an initial airsteam temperature of from 250° to 300° F. without heat damage or fire hazard. As the grain temperature gradually rises, it passes into the next heat zone in which the air temperature is reduced. This high initial temperature brings the moisture to the surface substantially immediately, and the combination of gradually decreasing air temperature gradient, and gradually increasing grain temperature gradient, maintains the sweating up until just before the time that the critical non-sweating grain temperature is reached, after which it enters the cooling zone.

Lower initial airstream temperatures must be used with most other grains, and the preferred temperature also varies with the moisture content, but the principle is that the uppermost heating zone is at a temperature approximating the maximum allowable temperature, and the lowermost heating zone is at a temperature such that the surface of the seed or kernel is sufficiently moist that the fines will not be dislodged by the airstream. One or more intermediate zones are at intermediate temperatures, selected so that sweating phenomenon is continuously maintained. This provides maximum utilization of heat and substantial fuel savings.

The advantages of my invention are not realized if one provides less than three heating zones because if the maximum allowable temperature is used in the uppermost zone, the seed or kernel surface will be dry by the time it gets to the lowermost zone, and if substantially less than maximum allowable temperature is used in the uppermost zone, drying capacity in terms of bushels per hour is sacrificed.

A further feature of my invention is that the chaff and fines removed prior to drying are conducted through one of the heating ducts so that they can be dried and then added to the dried grain, if desired.

I also provide a dual purpose tumbling screen device which separates the larger particles, "trash", from the grain as well as providing the first fines removal stage.

Other objects, features and advantages of my invention will become apparent as the description proceeds.

In the drawings:

FIG. 4 is a plan section of the device shown in FIG. 3;

FIG. 5 is a vertical section taken along line 5—5 of FIG. 4;

FIG. 6 is an enlarged vertical section taken along line 6—6 of FIG. 1;

FIG. 7 is a plan section along line 7—7 of FIG. 1, partially broken away;

FIG. 8 is a rear elevation taken along line 8—8 of FIG. 1, partially broken away; and FIG. 9 is a diagram showing an example of the temperatures of the airstreams in the second heating zones.

Figure 1:
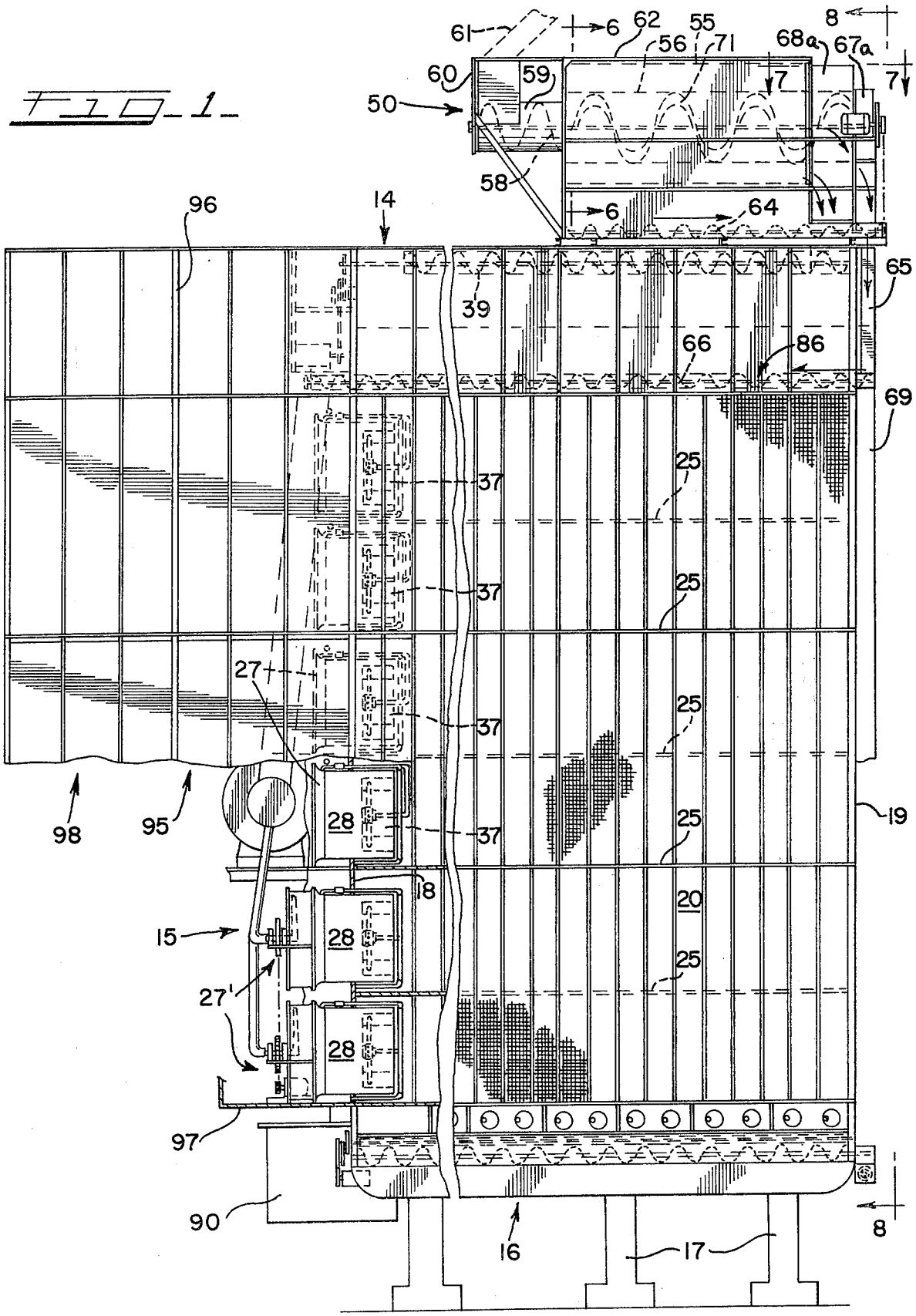
FIG. 1 is a side elevation of a grain dryer embodying my invention, partially broken away, and a portion being shown in section.

Referring now to FIG. 1, the grain dryer includes a rectangular structure having an upper supply portion 14, a dryer portion 15, and a base portion 16 which is mounted on a suitable concrete or steel foundation 17. The dryer portion 15 comprises a front end wall 18, a rear end wall 19, and perforated outer walls 20. Spaced inwardly of the latter are perforated inner walls 21, the upper edges of which are connected to each other by an imperforate pitched roof 22. Each set of perforated walls 20–21 provides a vertically extending passageway, referred to herein as opposed grain receiving columns 23 and 24 (FIG. 9) which are horizontally spaced from each other, and which run the entire length of the dryer portion 15. The body of grain received within either of these columns 23.24, may be referred to as the "grain column".

A plurality of horizontal partitions 25 connect the perforated inner walls 21 to each other, and extend from front to rear walls 18,19. These partitions provide a plurality of vertically superposed, horizontally extending air ducts. Associated with each air duct is a fan means 27 or 27', including a cylindrical duct 28 having a flared, or bell front, a propellor 29 (FIG. 2) and a motor 30.

In the embodiment shown herein there are six such air ducts, the upper four being heating ducts 31,32,33,34 of which the fan means 27 are intake fans which move the air into the duct from which it passes outwardly through the perforated walls of the grain receiving columns 23,24. Each such fan means 27 has associated with it an air heating means 37, such as a gas burner, located on the downstream side of the propellor 29, the motor 30 being on the upstream (front) side.

The two lower air ducts are cooling ducts 35,36 of which the fan means 27' are exhaust fans which cause the air to be drawn inwardly through the perforated walls 20,21 and out through the front wall 18. The fan means 27,27' are fitted into suitable openings in the front wall 18 and supported thereby.

The supply portion 14 of the grain dryer provides grain supply means 38, such as a hopper, for the grain receiving columns 23,24, the pitched roof 22 providing a sloping bottom. In the upper part of supply portion 14 there is a distributing auger conveyor 39, the trough portion 40 of which has a perforated bottom so as to distribute the grain substantially uniformly along the full length of hopper 38.

Located at the bottom of each column 23,24, and in the base portion 16, is a grain discharge means 41 (FIG. 8) which includes a metering paddle wheel 42 running the length of the column. This feeds the dried grain at a controlled rate to a fore and aft conveyor 43 which in turn feeds the grain to a transverse conveyor 44 and thence to grain outlet 45 (FIG. 8). The rate of grain column flow is controlled by the rotational speed of the paddle wheel 42. This grain discharge means is described in greater detail in my prior U.S. Pat. No. 3,129,073, granted Apr. 14, 1964.

To summarize the foregoing, grain fed into the distributing auger conveyor 39 and distributed to the hopper 38 passes down through one of the grain receiving columns 23,24 where it is traversed first by outwardly blowing heated air, and then by inwardly blowing air of ambient temperature. The speed of descent is regulated by the metering paddle wheel 42, from which the dried grain is delivered by conveyors 43,44 to grain outlet 45.

Mounted on the top of the supply portion 14 of the structure is a moist grain cleaner comprising the first fines removal stage. In the particular embodiment shown, the moist grain cleaner is in the form of a dual purpose tumbling screen device 50 which also separates the larger particles, "trash", from the incoming moist grain, although a separate trash remover can be provided if desired.

The device 50 (FIGS. 1, 6, 7, 8) comprises a shaft 51, suitably journalled at either end. Near the front end of the shaft 51 is an annular plate 52 (FIG. 6) and near the rear end there are flanged collars 53,54 (FIG. 7) which elements 52,53,54 are connected to shaft 51 by suitable spokes, not shown. Two concentric tumbling screens are carried by the shaft 51, an outer fine mesh screen 55 which extends from plate 52 to collar 53 and is secured thereto, and an inner coarse mesh screen which extends from plate 52 to collar 54 and is secured thereto.

The annular plate 52 is supported by grooved rollers 57 (FIG. 6), and the flanged collars 53,54 by similar rollers, not shown, to provide support for the weight of the grain being tumbled in the screens. The tumbling screen assembly is driven by chain and sprocket mechanism 48 from a motor 49 (FIG. 8).

Shaft 51 extends forwardly of the front wall of the closed receptacle 62 in which the outer screen 55 is located and carries a feed auger 58 received in a short duct 59 which communicates with receptacle 62 and extends from an inlet hopper 60 into which grain can be fed from a suitable conduit 61.

The closed receptacle 62 has sloping bottom walls 63. An auger conveyor 64 in the V between walls 63 conducts the fines in receptacle 62 to a vertical duct 65 which communicates with a fines conveyor 66 extending the length of heating duct 31.

In operation, the grain received in the inlet hopper 60 passes through the duct 59 to an enclosure 67 (FIG. 6) formed by the inner, coarse mesh screen 56. The grain and fines drop through the screen 56 into an enclosure 68 formed by the outer, fine mesh screen 55. The larger particles, "trash", move rearwardly through the enclosure 67 into a header 67A (FIG. 7) from which they drop through a conduit 69 (FIG. 8) to a suitable trash container, not shown.

The grain kernels and the fines are separated by the outer, fine mesh screen 55 with the fines dropping into the receptacle 62. The grain moves rearwardly through the enclosure 68 into a header 68A from which it drops through an opening 70 into the distributing auger conveyor 39.

A spiral vane 71 secured to the inner surface of screen 56 (FIG. 6) promotes feed-through of the trash, and a similar vane (not shown) is provided for the screen 55 to promote feed-through of the cleaned grain.

Figures 2, 3:
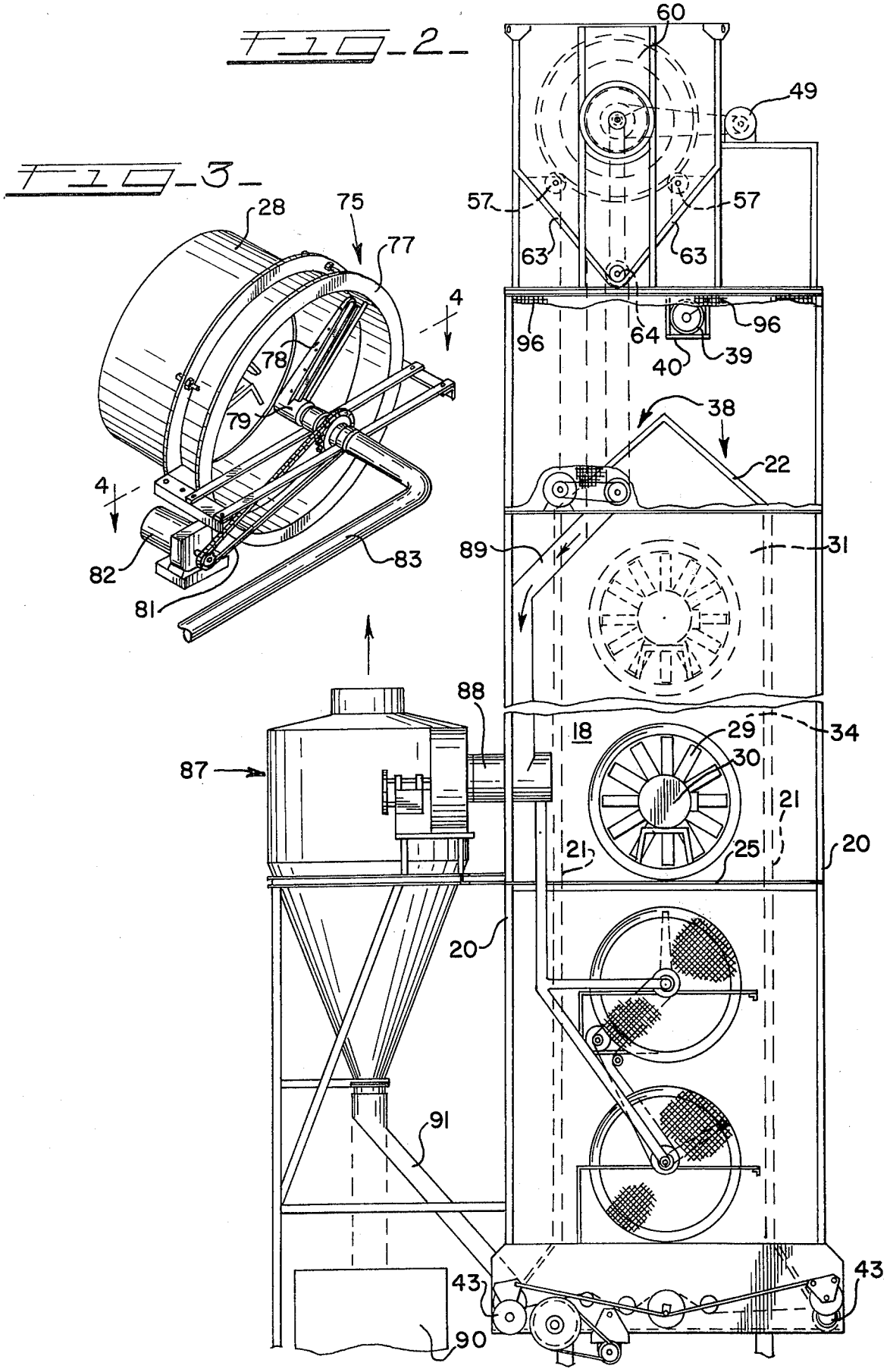
FIG. 2 is a front elevation of FIG. 1 with portions broken away to show underlying parts in elevation.
FIG. 3 is a perspective view of the filter cleaner of the second stage fines removal device, with the filter screen removed.

The second stage fines removal device 75 (FIGS. 3, 4) comprises a filter screen 76 (omitted in FIG. 3 for clarity) located at the downstream (front) side of each of the exhaust fan means 27'. The filter screen 76 is preferably in the form of a nylon or polyester screen of approximately 50 mesh, 36% open. The screen is removably mounted on a collar 77 secured to the bell end of the cylindrical duct 28 (FIG. 4). The screen is cleaned by means of a rotating suction shoe 78. The suction supply means includes a rotatably mounted hollow shaft 79 secured to the shoe 78, and journalled at 80, which is driven by suitable chain and sprocket drive means 81, including a motor 82 (FIG. 3). A rotating seal is provided between the hollow shaft 79 and the suction supply conduit 83. The rotating assembly 79,80 also includes a backing rod 84. The edges of the shoe 78 carry felt strips 85 (FIG. 5) engaging the screen 76.

The fines collected in enclosure 62 will have the same moisture content as the incoming grain; therefore, the auger conveyor 66 for the fines is located in the heating duct 31 to dry the fines. An air inlet 86 in the wall of the fines conveyor 66 permits entry of hot air which facilitates drying. A cyclone dust collector 87 (FIG. 2) is located at one side of the dryer, and its inlet 88 communicates with the fines conveyor 66 by a duct 89. The suction draws air into inlet 86 and through the fines conveyor 66. Similarly, the suction supply conduits 83 of the second stage fines removal device 75 are connected to the cyclone inlet 88 so that fines from both cleaners are drawn into the dust collector 87 and separated so that the air effluent of the dust collector is free from fines pollution. The fines can be delivered either to a container 90 (FIG. 2) or through a conduit 91 to one of the auger conveyors 43 for admixture with the clean dried grain. Since certain grain standards allow a small percentage of fines, e.g. 3% by weight, the admixture of the fines may increase economic yield.

To summarize the operation, the moist grain passing into the tumbling screen device 50 has the trash removed therefrom, and a substantial portion of the fines. It is then distributed by conveyor 39 into the hopper 38 for the grain receiving columns 23,24.

Referring not to FIG. 9, the individually controlled air temperature of the heating ducts 31 to 34 provides, due to the outwardly blowing air, four heating zones in the columns 23,24. For purpose of explanation, FIG. 9 shows heating air duct temperatures suitable for corn of 25% moisture content which enters the column at 60° F. In the uppermost zone A, the grain temperature may be raised up to from 100° to 110°, and here, the grain temperature along the inner wall 21 may be 10° to 20° higher than the temperature along the outer wall 20. However, as the gap between the air temperature and the grain temperature is narrowed in zones B,C,D, and due also to tumbling of the grain as the grain column descends, the inner-to-outer wall temperature differential diminishes. As a result, both the grain temperature and moisture content in zone D and in the lower part of zone C is substantially uniform.

As above indicated, the air temperature for zones B, C,D are selected so that the grain maintains its sweating up through zone D, but in no event should the air temperature for zone D be so high that the grain at the bottom of zone D would exceed the stress cracking temperature. In the cooling zone E, the incoming air temperature is ambient, say 60° to 70°. Now the grain temperature begins to drop, but the evaporation of the small remaining amount of moisture from the grain surface continues. The grain surface temperature is not higher than the air temperature, and the evaporation of surface moisture accelerates the cooling. Since the commercially acceptable moisture content of different grains is in the 13 to 15% range, no effort is made to dry the grain as a whole below this amount. However, in the presence of the cooling air-stream, the kernel surface will become sufficiently dry so that fines which were intentionally retained on the kernel surface in the heating zones are now dislodged. The purpose of the cooling zone is not to remove fines, but to cool the grain for shipment or storage. The purpose of providing (1) the inwardly blowing air, (2) the airstream concentration, and (3) the filter is not to remove fines, a certain percentage of which is commercially allowable, but to separate whatever fines are dislodged so as to avoid atmospheric pollution.

Whether more than one cooling zone is required depends only on whether the discharge temperature of the grain is low enough for shipment or storage. This, in turn, depends on the rate of descent of the grain column. I have found that if three 4-foot high heating zones are used, that one cooling zone is sufficient. However, if four 4-foot high heating zones are used, the rate of descent can be increased by approximately 50% which would require two cooling zone, E and F.

The manner in which the speed of the metering paddle wheel 42, and hence the descent of the grain column, is regulated by the moisture content of the grain column is described in my aforesaid U.S. Pat. No. 3,129,073.

Although the filtered air from the exhaust fan means 27' may be discharged directly into the atmosphere and admixed therewith, I prefer to provide a duct 95 enclosing the front wall 18 of dryer portion 15 and of the supply portion 14 to protect the exposed mechanism and to permit the use of a screen 96 to keep out birds and insects. The bottom of the duct 95 is closed by a partition 97 which causes the discharge from exhaust fans 27' to be admixed with the atmospheric air entering into the lowermost one or two of the intake fans 27. This is a heat saving feature since the discharge air is above ambient temperature.

Also, to reduce noise pollution, a second duct 98, disposed in front of duct 95, and lined with suitable sound absorbing material may be used to reduce noise pollution due to fan noise. Duct 98 is open at the bottom and communicates at its top with duct 95 through the screen 96.

Although only a preferred embodiment of my invention is shown and described herein, it will be understood that various modifications and changes can be made in the construction shown without departing from the spirit of my invention as pointed out in the appended claims.

I claim:

1. The method of drying moist grain in a perforated wall type dryer having cross-flow air which traverses a descending grain column comprising the steps of removing a substantial portion of the fines from the moist grain prior to entry thereof into said grain column, causing said grain column to descend through at least three superposed heating zones, the temperature of each heating zone beneath the uppermost being less than that of the heating zone next above it, said grain column being traversed in each heating zone by an airstream blowing outwardly into the atmosphere, causing said grain column to descend through a cooling zone beneath the lowermost of said heating zones, said grain column being traversed by an airstream blowing inwardly from the atmosphere, concentrating said inwardly blowing airstream after said grain column has been traversed thereby, filtering the fines from said concentrated airstream, and discharging said concentrated and filtered airstream for mixture with atmospheric air.

2. A grain dryer of the cross-flow type having means defining a pair of horizontally spaced opposed grain receiving columns, each having inner and outer perforated side walls and grain discharge means at the bottom for causing downward movement of the grain column in said grain receiving column, the combination of means for removing a substantial portion of the fines from the moist grain prior to the entry thereof into said grain receiving columns, means providing at least three superposed horizontally extending heating air ducts closed at one end and having an opening at the other end, the side walls thereof comprising said inner perforated walls, an intake fan located in each opening causing air to flow outwardly through said grain columns, air heating means associated with each intake fan providing for each successive heating duct beneath the uppermost heating duct a lesser air temperature than that provided by the heating means in the duct next above it, a cooling duct beneath said heating ducts and being similarly arranged thereto, an exhaust fan located at one end causing cooling air to flow inwardly through said grain columns, and filter means overlying the outlet of said exhaust fan.

3. A grain dryer of the cross-flow type having means defining a pair of horizontally spaced opposed grain receiving columns, each having inner and outer perforated side walls and grain discharge means at the bottom for causing downward movement of the grain column in said grain receiving column, and moist grain supply means at the top of said grain receiving columns, the combination of grain cleaning means communicating with said supply means for removing a substantial portion of the fines from said moist grain, horizontal partition dividing the space between said grain receiving columns into a plurality of vertically superposed horizontally extending air ducts closed at one end and each having an opening at the other end, a fan located in each opening, at least three of said air ducts being heating ducts in which said fans are intake fans and having air heating means associated with each said intake fan, and at least one of said ducts being a cooling duct of which the associated fan is an exhaust fan, filter means overlying the outlet of each said exhaust fan, and filter cleaning means associated with each said filter means.

4. A grain dryer as claimed in claim 3 in which the air heating means associated with each heating duct beneath the uppermost heating duct provides for each successive duct a lesser air temperature than that provided by the heating means in the duct next above it.

5. A grain dryer as claimed in claim 3 in which said filter means comprises a screen, and said filter cleaning means comprises a continuously rotating suction shoe adjacent to said screen.

6. A grain dryer as claimed in claim 5 which includes means for collecting the fines from said grain cleaning means and from said filter cleaning means and feeding it into one of said grain discharge means, said collecting means for said grain cleaning means including a conveyor located in one of said heating ducts so that the fines from said grain cleaning means will be dried prior to admixing with the dried grain in said discharge means.

7. A grain dryer as claimed in claim 3 which includes a negative pressure collector means for collecting the fines from said grain cleaning means, a conveyor extending from said grain cleaning means to said collector means and having a portion located in one of said heating ducts, an air inlet in the wall of said conveyor permitting entry of hot air into said conveyor, said negative pressure collector means drawing said hot air through said conveyor to facilitate drying said fines.

8. A grain dryer as claimed in claim 3 in which grain cleaning means comprises two concentric tumbling screens, the innermost screen separating the trash from the grain and fines, and the outermost separating the fines from the grain.

9. A grain dryer as claimed in claim 8 in which said supply means includes a hopper for said grain receiving columns and distributor means feeding grain into said hopper means, and means providing communication between the space enclosed by said inner and outer screens, and said distributor means.

10. A grain dryer as claimed in claim 3 which includes four heating ducts and two cooling ducts.

* * * * *